US006135694A

United States Patent [19]

Trego et al.

[11] Patent Number: 6,135,694

[45] Date of Patent: Oct. 24, 2000

[54] TRAVEL AND FORK LOWERING SPEED CONTROL BASED ON FORK LOAD WEIGHT/TILT CYLINDER OPERATION

[75] Inventors: Allen T. Trego, New Bremen; Daniel C. Magoto, Russia; Donald E. Luebrecht, Fort Jennings, all of Ohio

[73] Assignee: Crown Equipment Corporation, New Bremen, Ohio

[21] Appl. No.: 09/163,057

[22] Filed: Sep. 29, 1998

Related U.S. Application Data

[60] Provisional application No. 60/070,969, Sep. 30, 1997.

[51] Int. Cl.[7] ..... B66F 9/16; B66F 9/20

[52] U.S. Cl. ..... 414/21; 414/636

[58] Field of Search ..... 414/21, 629, 631, 414/636, 814

[56] References Cited

U.S. PATENT DOCUMENTS

| | | | |
|---|---|---|---|
| 3,834,494 | 9/1974 | Bates et al. | 187/224 |
| 4,023,650 | 5/1977 | Pleier | 187/224 |
| 4,206,829 | 6/1980 | Melocik | 414/21 X |
| 4,517,645 | 5/1985 | Yuki et al. | 414/636 X |
| 4,942,529 | 7/1990 | Avitan et al. | 414/636 X |
| 4,957,408 | 9/1990 | Ohkura | 414/21 X |
| 5,103,226 | 4/1992 | Dammeyer et al. | 341/14 |
| 5,586,620 | 12/1996 | Dammeyer et al. | 187/227 |
| 5,666,295 | 9/1997 | Bruns | 414/21 X |

FOREIGN PATENT DOCUMENTS

| | | |
|---|---|---|
| 0 343 839 A2 | 11/1989 | European Pat. Off. . |
| 0 511 486 A1 | 11/1992 | European Pat. Off. . |
| 2 321 448 | 3/1977 | France . |
| 2 267 696 | 12/1993 | United Kingdom . |

*Primary Examiner*—James W. Keenan
*Attorney, Agent, or Firm*—King and Schickli, PLLC

[57] ABSTRACT

A fork lift truck includes a body, a drive mechanism supported on the body for effecting movement of the body, and a fork carrying assembly carrying forks which can be moved in height between a lowered position and desired raised positions. A tilt cylinder is provided for tilting the forks through a fork tilt range. The truck further includes a pressure sensor capable of generating signals indicative of the weight of a load on the forks, a fork tilt position sensor capable of being activated when the forks are tilted to extremes of the fork tilt range, and a controller. The controller is coupled to the drive mechanism, the pressure sensor and the fork tilt position sensor. It causes the drive mechanism to effect movement of the body up to a first maximum speed when at least one of the pressure sensor generates a signal indicative of a load on the forks having a weight above a predetermined value and the tilt position sensor is activated, and causes the drive mechanism to effect movement of the body up to a second maximum speed which is greater than the first maximum speed when the pressure sensor generates a signal indicative of no load or a load on the forks having a weight below the predetermined value and the tilt position sensor is inactivated. The lowering speed of the forks can also or alternatively be increased under the same operating conditions.

17 Claims, 3 Drawing Sheets

TRAVEL AND FORK LOWERING SPEED CONTROL BASED ON FORK LOAD WEIGHT/TILT CYLINDER OPERATION

CROSS-REFERENCE TO RELATED APPLICATIONS

This application claims the benefit of U.S. Provisional Application Ser. No. 60/070,969, filed Sep. 30, 1997, and entitled PRODUCTIVITY PACKAGE, which is incorporated herein by reference. This application is also related to previously filed U.S. patent application, Ser. No. 09/108,735, filed Jul. 1, 1998, now U.S. Pat. No. 5,995,001 which is also incorporated herein by reference.

BACKGROUND OF THE INVENTION

This invention relates to a method and apparatus for increasing the speed at which a fork lift truck travels and/or the lowering speed of the truck's forks when the forks are unloaded or substantially unloaded.

Industry braking standards require that a loaded truck stop within a predetermined distance or comply with a well known drawbar drag test. Most fork lift trucks are not provided with a weight sensor for determining if the truck is loaded; therefore, the maximum speed of the truck does not change based upon the load status of the forks. If the truck is not loaded, then there is excess braking capacity and the truck could be allowed to travel at a faster speed and still meet industry braking requirements.

The forks are raised and lowered by at least one hydraulic cylinder. It is known to provide a mechanical proportional valve to control the flow of hydraulic fluid to and from that cylinder. Operation of the valve is controlled by an operator via a control handle. The hydraulic system including the valve is designed so as to allow the forks, when fully loaded, to descend at a limited rate. No provision is provided to allow the forks to be lowered at an increased rate when the forks are unloaded.

There is a need for an improved method and apparatus for increasing the speed at which a fork lift truck travels and/or the lowering speed of the truck's forks when the forks are unloaded or substantially unloaded so as to increase productivity.

SUMMARY OF THE INVENTION

In the present invention, the maximum speed of a fork lift truck is increased whenever the forks are unloaded or substantially unloaded. Also, the fork lowering speed is increased when the forks are unloaded or substantially unloaded. By increasing the speed of the truck and/or the lowering speed of the forks when the forks are unloaded or substantially unloaded, productivity is increased.

In the present invention, the pressure of hydraulic fluid within a fork tilt cylinder is monitored either by a pressure switch or a pressure transducer. The pressure in the tilt cylinder is a function of the weight being carried by the forks. Whenever that weight is below a predetermined value, then the forks are considered to be unloaded or substantially unloaded and a truck controller will permit a higher truck speed.

A tilt position sensor is also provided to detect when the forks are tilted to extremes of a fork tilt range. Because the piston in the tilt cylinder tops out or bottoms out when the forks are fully tilted up or down, the pressure detected by the pressure switch or the pressure transducer is not indicative of the actual weight on the forks when the forks are in one of these extreme positions.

The tilt position sensor may comprise a switch which is activated when thc forks are tilted fully up or down. The pressure switch is activated or the transducer generates an appropriate signal to the controller whenever the load is above the predetermined value. Activation of the tilt position sensor switch indicating that the weight of the load cannot be accurately determined or activation of the pressure switch or generation of an appropriate signal by the transducer indicating that the load is above the predetermined value will result in the speed of the truck being limited to no more than a first maximum speed, i.e., the maximum speed allowable for a fully loaded truck. If the weight of the load can be accurately determined, i.e., the forks are not fully tilted up or down, and the weight is below the predetermined value, then the speed of the truck may be increased up to a second maximum speed which is greater than the first maximum speed. Industry braking standards are still met at the second maximum speed.

The lowering speed of the forks is controlled by an electrical proportional hydraulic valve which, in turn, is controlled by the truck controller. When the weight of the load is below the predetermined value, and the forks are not fully tilted up or down, then the controller generates appropriate signals to the electrical valve so as to allow the forks to descend at an increased rate.

DETAILED DESCRIPTION OF THE INVENTION

Figure 1:
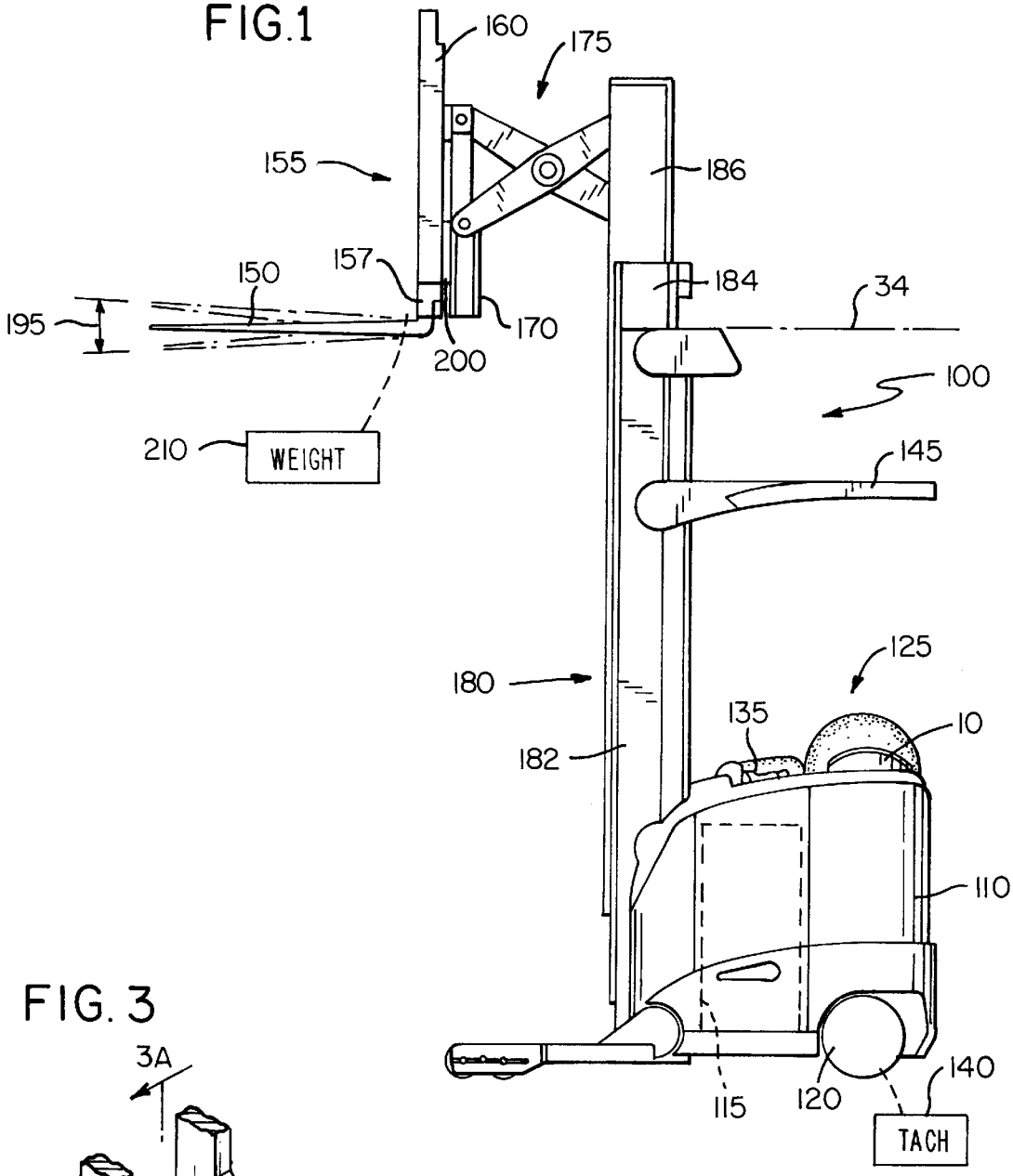
FIG. 1 is a side view of a typical rider reach lift truck.

FIG. 1 illustrates a typical rider reach fork lift truck 100, such as Series RR or RD lift trucks manufactured by Crown Equipment Corporation, the assignee of the present application. The truck 100 includes a body 110 which houses a battery 115 for supplying power to a traction motor (not shown) connected to a steerable wheel 120 and to one or more hydraulic motors (not shown) which supply power to several different systems, such as mast, fork and reach hydraulic cylinders. The traction motor and the steerable wheel 120 define a drive mechanism for effecting movement of the truck 100. An operator's compartment 125 in the body 110 is provided with a steering tiller (not shown) for controlling the direction of travel of the truck 100, and a control handle 135 for controlling travel speed and direction as well as fork height, extension, side shift, and tilt. The speed of the truck 100 is measured by a tachometer, represented at 140, included within the truck 100 in a conventional manner. An overhead guard 145 is placed over the operator's compartment 125.

A pair of forks 150 are mounted on a fork carriage mechanism 155 which is in turn mounted on a carriage plate 170. The fork carriage mechanism 155 includes a fork carriage 157 and a load back rest 160. The forks 150 are coupled to the fork carriage 157 which is in turn coupled to the carriage plate 170. As described in U.S. Pat. No. 5,586,620, which is incorporated herein by reference, the carriage plate 170 is attached to an extensible mast assembly 180 by a scissors reach mechanism 175 extending between the carriage plate 170 and a reach support. The reach support is mounted to the mast assembly 180 which includes a fixed, lower mast member 182 and nested movable mast members 184 and 186. The reach support is not illustrated in FIG. 1 as it is coupled to and hidden behind mast member 186. The lower member 182 is fixedly coupled to the body 110. The fork carriage mechanism 155, the carriage plate 170, the mast assembly 180, the reach support and the reach mechanism 175 define a fork carrying assembly.

The mast assembly 180 includes a plurality of hydraulic cylinders (not shown) for effecting vertical movement of the mast members 184 and 186 and the reach support. An electrical proportional hydraulic valve 300, coupled to a truck controller 80, see FIG. 5, controls and directs hydraulic fluid to the mast assembly hydraulic cylinders. An operator controls the height of the forks 150 via the control handle 135, which is also coupled to the controller 80. In response to receiving fork elevation command signals from the handle 135, the controller 80 generates control signals of an appropriate pulse width to the valve 300 and further generates control signals so as to operate one or more hydraulic fluid pumps (not shown) at an appropriate speed to raise the forks 150. In response to receiving fork lowering command signals from the handle 135, the controller 80 generates control signals of an appropriate pulse width to the valve 300 so as to lower the forks 150. As shown in FIG. 1, the movable mast members 184 and 186, as well as the reach support (not illustrated), are raised and the reach mechanism 175 is extended.

Figure 3:
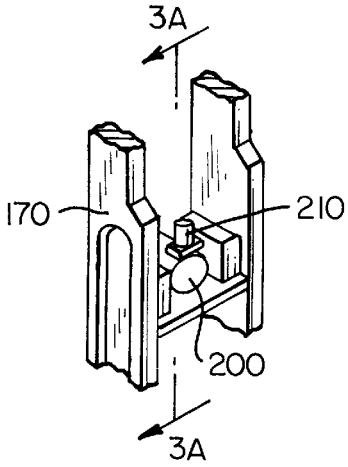
FIG. 3 is a view of a portion of the carriage plate, the tilt cylinder, and the pressure sensor.
Figure 2:
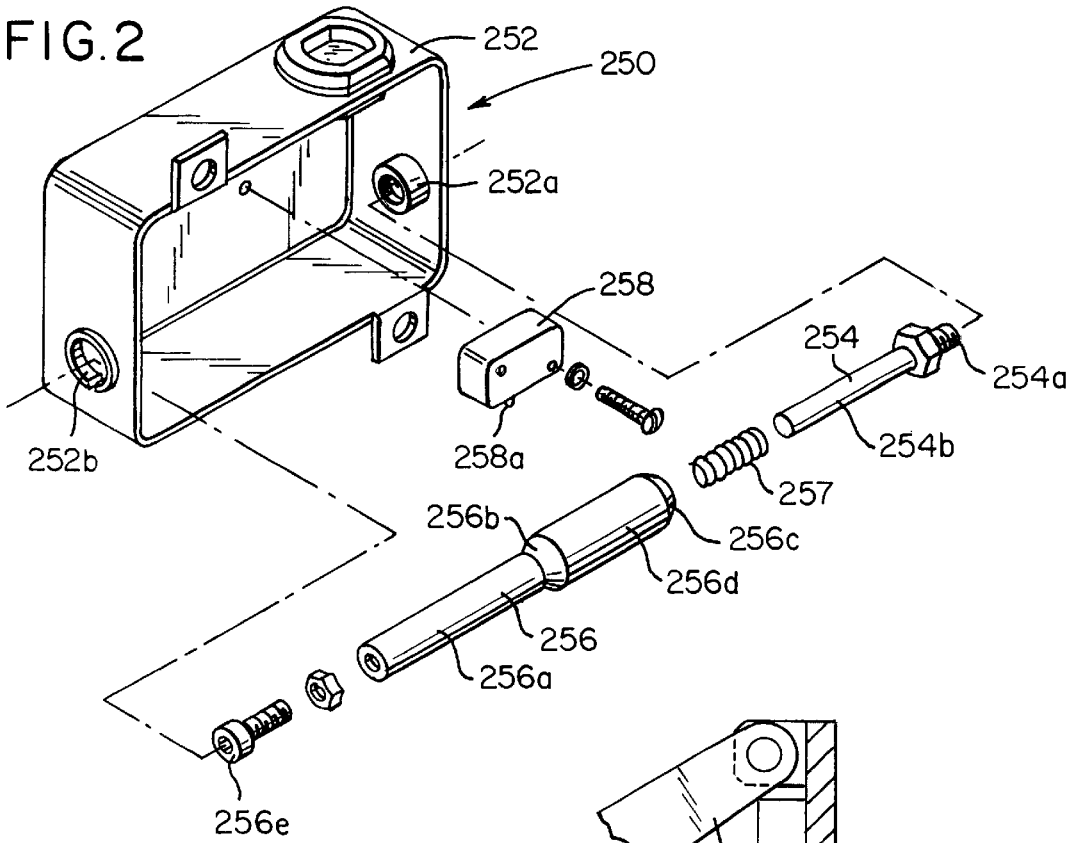
FIG. 2 is an exploded view of the tilt position sensor.
Figure 3A:
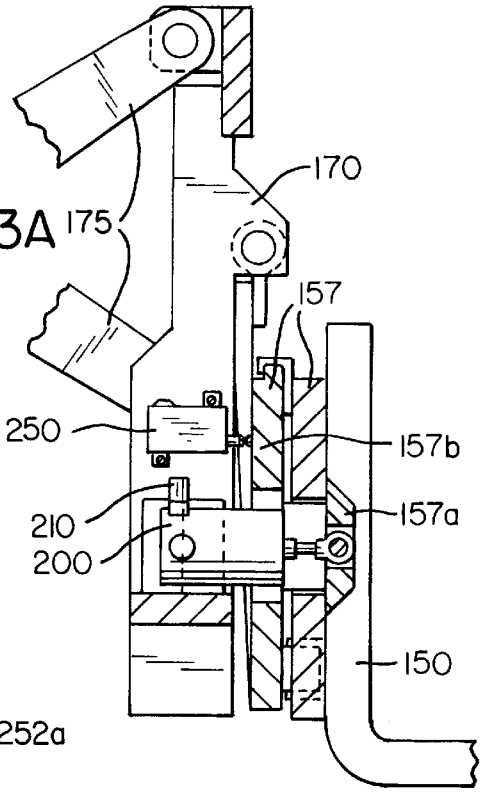
FIG. 3A is a view taken along view line 3A—3A in FIG. 3 with the fork carriage, a portion of a fork, a portion of the scissors reach mechanism and the tilt sensor also illustrated.

The forks 150 may be tilted through a range shown by the arrow 195 by means of a hydraulic tilt cylinder 200 coupled to a first portion 157*a* of the fork carriage 157 and the carriage plate 170, see FIG. 3A. The pressure of hydraulic fluid within the tilt cylinder 200 is monitored using a pressure switch or pressure transducer which serves as a pressure sensor 210 that is coupled to the tilt cylinder 200, see FIGS. 3, 3A and 4. A tilt position sensor 250, see FIGS. 2, 2A, 3A and 5, is activated whenever the forks 150 are fully tilted up or down, as will be explained.

Figure 4:
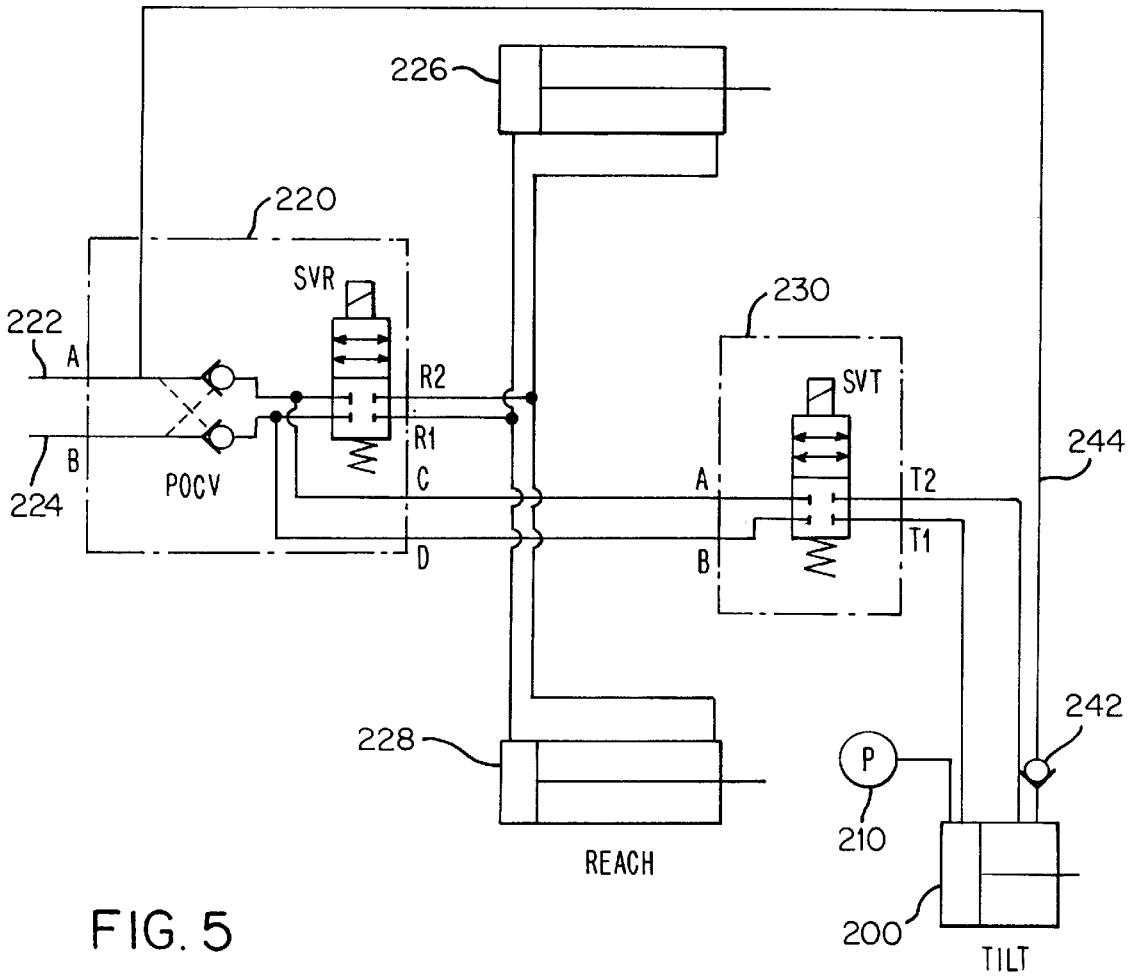
FIG. 4 is a hydraulic schematic diagram showing the pressure sensor connected to the tilt cylinder.

Referring now to FIG. 4, which is a hydraulic schematic diagram for the reach, side shift and tilt functions of the fork lift truck 100 shown in FIG. 1, hydraulic fluid under pressure is supplied to a hydraulic manifold 220 by hydraulic input lines 222 and 224. The hydraulic manifold 220 is coupled to the reach support. Within the manifold 220 are a pair of check valves POCV and a solenoid valve SVR which controls hydraulic fluid to a pair of reach cylinders 226 and 228, which form part of the scissors reach mechanism 175.

Hydraulic fluid under pressure is also applied to a manifold 230 which includes a solenoid valve SVT for controlling the operation of the tilt cylinder 200. The manifold 230 is coupled to the carriage plate 170. A check valve 242 is included in a return line 244, which is in turn connected to the input line 222. The pressure sensor 210 is connected to one side of the tilt cylinder 200 to monitor the pressure of the hydraulic fluid in the tilt cylinder 200. The pressure in the cylinder 200 is a function of the weight being carried by the forks 150, provided, of course, that the piston in the tilt cylinder 200 has not topped out or bottomed out within the cylinder. When the piston is in one of these two extreme positions, which occurs when the forks 150 are either fully tilted up or down, the pressure detected by the pressure sensor 210 does not correspond to the actual weight of the load on the forks 150.

Tilting of the forks 150 is monitored by the sensor 250 which is activated whenever the forks 150 are in their full tilt up or full tilt down positions. In the illustrated embodiment, the tilt sensor 250 comprises a housing 252 mounted to the carriage plate 170, see FIG. 3A. It has a threaded first opening 252*a* and a second opening 252*b*. A rod 254 is provided in the housing 252. It includes a first threaded end 254*a* which threadedly engages the first opening 252*a* such that the rod 254 is locked in position within the housing 252. A plunger 256, having an internal bore (not shown), is received over a nose portion 254*b* of the rod 254 such that the plunger 256 is permitted to reciprocate back and forth along the rod 254. A spring 257 is also received over the nose portion 254*b* of the rod 254 and biases the plunger 256 in a direction away from the rod first threaded end 254*a*. The plunger 256 has an elongated front portion 256*a*, first and second camming surfaces 256*b* and 256*c*, and an enlarged intermediate portion 256*d* located between the camming surfaces 256*b* and 256*c*. A switch 258, which in the illustrated embodiment comprises a normally closed micro switch, is fixedly coupled to the housing 252. It includes a button 258*a* which is engaged by the first and second camming surfaces 256*b* and 256*c* and the enlarged portion 256*d* of the plunger 256 as the plunger 256 moves back and forth over the rod 254.

Figure 2A:
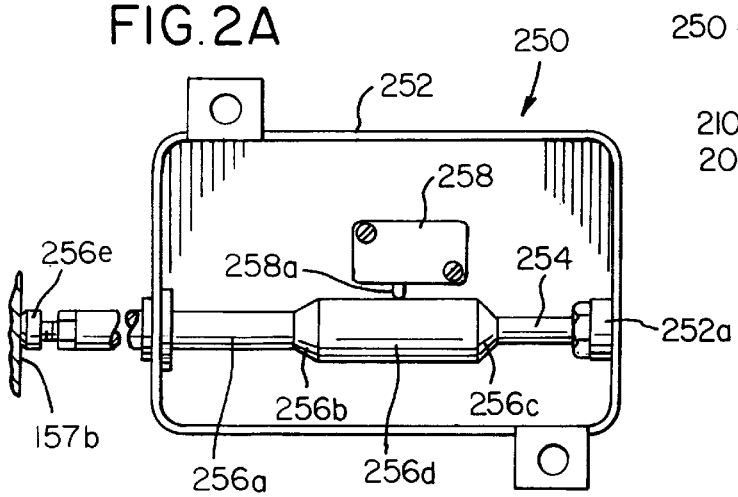
FIG. 2A is a side view illustrating the tilt position sensor when assembled.

An end portion 256*e* of the plunger engages a second portion 157*b* of the fork carriage 157, see FIGS. 2A and 3A. As the forks 150 are tilted up or down, the plunger 256 is caused to move back and forth along the rod 254. When the forks 150 are extended to substantially the full tilt up position, the button 258*a* moves downwardly along the camming surface 256*c* causing the switch 258 to be activated, i.e., to open. When the forks 150 are extended to substantially the full tilt down position, the button 258*a* moves downwardly along the camming surface 256*b* also causing the switch 258 to be activated. Hence, the tilt sensor switch 258 is activated when the pressure signal generated by the pressure sensor 210 may not correspond to the actual weight on the forks 150 due to the forks 150 being fully tilted up or down. The switch 258 is inactivated, i.e., closed, when the forks 150 are not fully tilted up or down such that the button 258*a* engages the enlarged portion 256*d* of the plunger 256.

The pressure sensor 210 may comprise a normally closed pressure switch which is activated, i.e., opened, when the weight on the forks 150 is above a predetermined value or amount, e.g., 1000 pounds at a 24 inch load center. The predetermined value may be less than or greater than 1000 pounds. Alternatively, the pressure sensor 210 comprises a transducer which provides an output signal proportional to weight.

In the illustrated embodiment, the pressure sensor 210 is connected in series with the switch 258 in an input path to the controller 80. When the switch 258 is closed, the signal generated by the pressure sensor 210 will pass through the switch 258 and be received by the controller 80. When the switch 258 is open, the signal generated by the pressure sensor 210 will not pass through the switch 258 and, hence, will not be received by the controller 80. When the pressure sensor 210 comprises a normally closed pressure switch and is activated, i.e., the switch is open, and the switch 258 is closed, the input path to the controller 80 is opened. When the pressure sensor 210 comprises a normally closed pressure switch and is inactivated, i.e., the switch is closed, and the switch 258 is closed, the input path to the controller 80 is closed.

Figure 5:
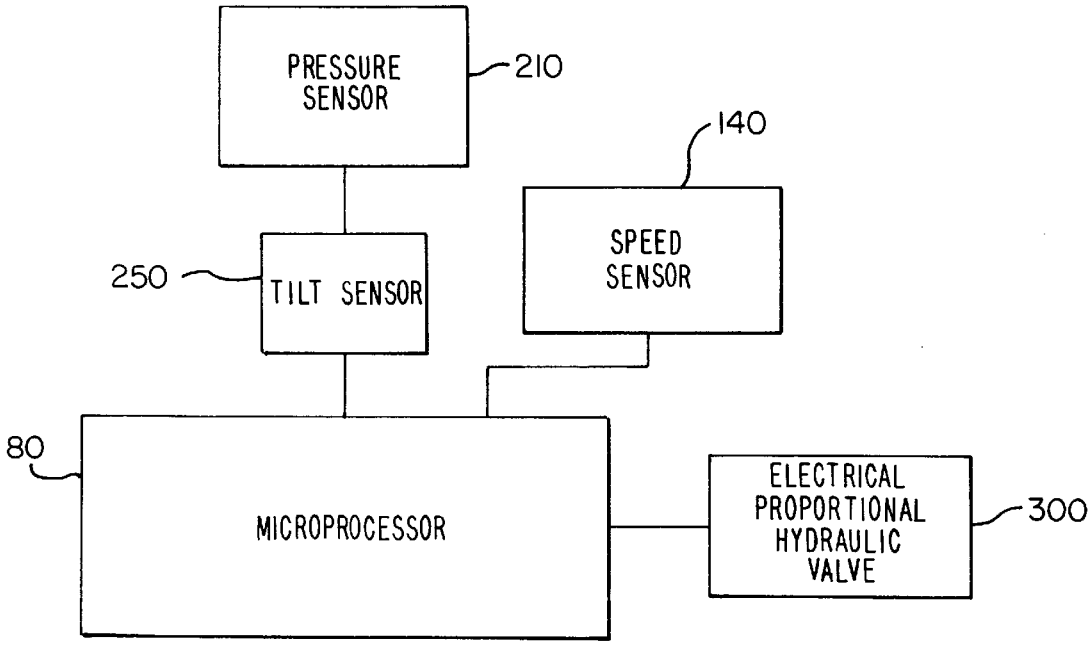
FIG. 5 is an electrical block diagram of the present invention.

The electrical block diagram of FIG. 5 shows a speed sensor illustrated as the tachometer 140, the pressure sensor 210, the valve 300, and the tilt sensor 250 connected to a controller 80 taking the form of a microprocessor in the illustrated embodiment.

An operator increases the travel speed of the truck 100 by moving or otherwise causing an appropriate change in the status of the control handle 135. The pressure sensor 210, when it comprises a normally closed pressure switch, opens when the weight on the forks 150 is above a predetermined amount. In the illustrated embodiment, if the weight on the forks 150 is above 1000 pounds at a 24 inch load center, the switch opens. Whenever the pressure switch or the tilt sensor switch is open, indicating that the weight on the forks 150 is above the predetermined amount and/or the forks 150 are fully up or down, the controller 80 will only allow the truck to accelerate up to a first maximum speed. If, however, the pressure switch and the tilt sensor switch are both closed, indicating that the forks 150 are unloaded or substantially unloaded, i.e., the forks 250 are carrying a load less than the predetermined value, and the forks 150 are not tilted fully up or down, then the controller 80 will allow the truck to accelerate up to a second maximum speed which is greater than the first maximum speed.

For example, for a lift truck such as one which is commercially available from Crown Equipment Corporation under the product designation RR5020-35, the first maximum first speed is 7.2 MPH when the body 10 is traveling first (5.7 MPH when the forks 150 are traveling first) and the second maximum speed is 7.8 MPH when the body 110 is traveling first (6.5 MPH when the forks 150 are traveling first). For a lift truck such as one which is commercially available from Crown Equipment Corporation under the product designation RR5080S-45, the first maximum first speed is 7.5 MPH when the body 110 is traveling first (6.2 MPH when the forks 150 are traveling first) and the second maximum speed is 8.3 MPH when the body 110 is traveling first (6.7 MPH when the forks 150 are traveling first).

In the illustrated embodiment, when the pressure sensor 210 comprises a pressure switch, the controller 80 requires that the pressure switch maintain a new state (open/closed) for a predetermined time, e.g., 700 milliseconds, before the new state will be recognized.

If the pressure sensor 210 is a pressure transducer, the controller 80 will only allow the truck 100 to accelerate up to the second maximum speed when the pressure transducer generates a signal indicating that the weight on the forks 150 is below the predetermined value and the tilt sensor switch is closed. If the pressure transducer generates a signal indicating that the weight on the forks 150 is above the predetermined value and/or the tilt sensor switch is open, then the controller 80 will only allow the truck 100 to accelerate up to the first maximum speed.

The controller 80 causes the valve 300 to effect downward movement of the forks toward the body 110 or ground (the surface upon which the truck 100 is operated) up to a first maximum speed when the pressure sensor 210 generates a signal to the controller 80 indicative of a load on the forks 150 having a weight above the predetermined value and/or the tilt position sensor switch is open indicating that the forks 150 are in their tilted fully up or down positions. When the pressure sensor 210 comprises a normally closed pressure switch, it generates a signal to the controller 80 indicative of a load on the forks 150 having a weight above the predetermined value by opening the input path to the controller 80. The controller 80 also causes the valve 300 to effect downward movement of the forks 150 toward the body 110 or ground up to a second maximum speed which is greater than the first maximum speed when the pressure sensor 210 generates a signal to the controller 80 indicative of no load or a load on the forks having a weight below the predetermined value and the tilt position sensor switch is closed. When the pressure sensor 210 comprises a normally closed pressure switch, it generates a signal to the controller 80 indicative of no load or a load on the forks 150 having a weight below the predetermined value by closing the input path to the controller 80. The first maximum descent speed may be 90 feet/minute while the second maximum descent speed may be 110 feet/minute.

In order for the forks 150 to descend at a speed up to 110 feet/minute, the hydraulic system including the valve 300 must be designed such that restrictions within that system are minimized.

It is also contemplated that the controller 80 may allow the drive mechanism to accelerate the body 110 up to the second maximum speed without increasing the rate at which the forks move toward ground when the pressure sensor 210 generates a signal to the controller 80 indicative of no load or a load on the forks having a weight below the predetermined value and the tilt position sensor switch is closed. Alternatively, the controller 80 may increase the rate at which the forks 150 move toward ground without allowing the drive mechanism to accelerate the body 110 up to the second maximum speed when the pressure sensor 210 generates a signal to the controller 80 indicative of no load or a load on the forks having a weight below the predetermined value and the tilt position sensor switch is closed.

It is additionally contemplated that the controller may allow the drive mechanism to accelerate the body 110 up to the second maximum speed based only upon signals received from a pressure sensor. It is further contemplated that other conventional sensors not discussed herein may be used for generating signals indicative of the weight of a load on the forks.

What is claimed is:

1. A fork lift truck comprising:

a body;

a drive mechanism supported on said body for effecting movement of said body;

a pair of forks;

a fork carrying assembly coupled to said body and said forks for moving said forks in height between a lowered position and desired raised positions, said fork carrying assembly including a tilt cylinder for tilting said forks through a fork tilt range;

a first sensor capable of generating signals indicative of the weight of a load on said forks, said first sensor being associated with said tilt cylinder for monitoring fluid pressure in said tilt cylinder which pressure is a function of the weight being carried by said forks; and a controller coupled to said drive mechanism and said first sensor, said controller causing said drive mechanism to effect movement of said body up to a first maximum speed when said controller receives a signal generated by said first sensor indicative of a load on said forks above a predetermined weight value and causing said drive mechanism to effect movement of said body up to a second maximum speed which is greater than said first maximum speed when said controller receives a signal generated by said first sensor indicative of no load or a load on said forks below said predetermined value.

2. A fork lift truck as set forth in claim 1, wherein said first sensor comprises a pressure transducer.

3. A fork lift truck as set forth in claim 1, wherein said first sensor comprises a pressure switch.

4. A fork lift truck as set forth in claim 3, wherein said pressure switch is activated when said forks are carrying a load greater than about 1000 pounds.

5. A fork lift truck as set forth in claim 1, wherein said fork carrying assembly comprises a mast assembly having two or more mast members and an elevating device coupled to said body and at least one of said mast members, said elevating device causing said at least one mast member to move toward and away from ground, and said at least one mast member being coupled to said forks such that said forks move with said at least one mast member.

6. A fork lift truck as set forth in claim 5, wherein said controller is further coupled to said elevating device, said controller causing said elevating device to effect movement of said forks toward ground up to a first maximum speed when said controller receives a signal from said first sensor indicative of a load on said forks above a predetermined value and causing said elevating device to effect movement of said forks toward ground up to a second maximum speed which is greater than said first maximum speed when said controller receives a signal from said first sensor indicative of no load or a load on said forks having a weight below said predetermined value.

7. A fork lift truck as set forth in claim 1, wherein said controller further causes said drive mechanism to effect movement of said body up to said first maximum speed when no signal from said first sensor is received by said controller.

8. A fork lift truck as set forth in claim 7, further comprising a second sensor which prevents signals generated by said first sensor from passing to said controller when the weight of the load on said forks cannot be accurately determined.

9. A fork lift truck as set forth in claim 8, wherein said second sensor comprises a fork tilt position sensor which is capable of detecting when said forks are tilted to extremes of a fork tilt range.

10. A fork lift truck comprising:

a body;

a drive mechanism supported on said body for effecting movement of said body;

a pair of forks;

a fork carrying assembly coupled to said body and said forks for moving said forks in height between a lowered position and desired raised positions, said carrying assembly including a tilt cylinder for tilting said forks through a fork tilt range;

a first sensor capable of generating signals indicative of the weight of a load on said forks;

a fork tilt position sensor capable of being activated when said forks are tilted to extremes of said fork tilt range; and a controller coupled to said drive mechanism, said first sensor and said fork tilt position sensor, said controller causing said drive mechanism to effect movement of said body up to a first maximum speed when at least one of said first sensor generates a signal indicative of a load on said forks having a weight above a predetermined value and said tilt position sensor is activated, and causing said drive mechanism to effect movement of said body up to a second maximum speed which is greater than said first maximum speed when said first sensor generates a signal indicative of no load or a load on said forks having a weight below said predetermined value and said tilt position sensor is inactivated.

11. A fork lift truck as set forth in claim 10, wherein said first sensor is associated with said tilt cylinder for monitoring fluid pressure in said tilt cylinder which fluid pressure is a function of the weight being carried by said forks.

12. A fork lift truck as set forth in claim 11, wherein said first sensor comprises a pressure transducer.

13. A fork lift truck as set forth in claim 11, wherein said first sensor comprises a pressure switch.

14. A fork lift truck as set forth in claim 13, wherein said pressure switch is activated when said forks are carrying a load greater than about 1000 pounds.

15. A fork lift truck as set forth in claim 10, wherein said fork carrying assembly further comprises two or more mast members and an elevating device coupled to said body and at least one of said mast members, said elevating device causing said at least one mast member to move toward and away from ground, and said at least one mast member being coupled to said forks such that said forks move with said at least one mast member.

16. A fork lift truck as set forth in claim 15, wherein said controller is further coupled to said elevating device, said controller causing said elevating device to effect movement of said forks toward ground up to a first maximum rate when at least one of said first sensor generates a signal indicative of a load on said forks having a weight above a predetermined value and said tilt position sensor is activated and causing said elevating device to effect movement of said forks toward ground up to a second maximum rate which is greater than said first maximum rate when said first sensor generates a signal indicative of no load or a load on said forks having a weight below said predetermined value and said tilt position sensor is inactivated.

17. A fork lift truck as set forth in claim 10, wherein said tilt position sensor comprises a switch.

* * * * *